United States Patent [19]

Groves

[11] Patent Number: 4,664,374

[45] Date of Patent: May 12, 1987

[54] ADJUSTABLE PRACTICE BATTING TEE

[76] Inventor: Keith N. Groves, 178 E. 4500 South, Salt Lake City, Utah 84124

[21] Appl. No.: 817,581

[22] Filed: Jan. 10, 1986

[51] Int. Cl.[4] ..... A63B 69/40

[52] U.S. Cl. ..... 273/26 R

[58] Field of Search ..... 273/26 R, 26 A, 29 A, 273/32 D, 202, 203, 201, 204, 205, 206, 207, 208, 209, 210, 211, 212, 183 A

[56] References Cited

U.S. PATENT DOCUMENTS

| | | | |
|---|---|---|---|
| 2,202,556 | 5/1940 | Jordan | 273/203 |
| 2,616,692 | 11/1952 | Bird | 273/26 R |
| 3,139,282 | 6/1964 | Lande | 273/26 R |
| 3,489,411 | 1/1970 | Morelli et al. | 273/26 R |
| 3,550,938 | 12/1970 | Cunningham, Jr. | 273/26 R |

*Primary Examiner*—Richard C. Pinkham
*Assistant Examiner*—T. Brown
*Attorney, Agent, or Firm*—J. W. Brown and Associates

[57] ABSTRACT

An adjustable practice batting tee comprising a planar base, an elongated slotted horizontal support member adapted to moving over the top of the base and attached thereto by an adjustable lock placed within the slot, an L shaped elongated tubular pedestal having a long tubular arm and a short tubular arm and being pivotedly attached by a lock at the apex of the L to one end of the elongated slotted support member such that the pedestal can be pivoted to have one of the tubular arms in a vertical position and the other in a horizontal position and visa versa, the end of both arms being adapted to holding a baseball or softball.

7 Claims, 8 Drawing Figures

ADJUSTABLE PRACTICE BATTING TEE

BACKGROUND OF THE INVENTION

1. Field of the Invention

This invention relates to a new practice batting or hitting tee. More particularly, the invention relates to a baseball or softball practice tee that can be easily adjusted to the right position with a mimimum of effort.

Specifically, the invention provides a new type of baseball and softball practice tee that is easily adjustable for use in training young ball players to acquire timing, wrist action and swing. The new tee broadly comprises a planar base, an elongated slotted horizontal support member adapted to moving over the top of the base and attached thereto by an adjustable locking means placed within the slot such that in the unlocked position the support member can be slid along the planar base to a new location on the base and then locked in the desired position, an L shaped elongated tubular pedestal having a long tubular arm and a short tubular arm and being pivotedly attached by locking means in the center of a U support which is firmly attached to the end of the elongated slotted horizontal support member such that the L shaped tubular pedestal can be pivoted to have one of the tubular arms in a vertical position and the other arm in a horizontal position and then locked in that position, and both of the arms of the L shaped tubular pedestal having attached at the open end an elongated resilient tubular member adapted to holding a ball at the unright terminal end.

2 Prior Art

In the game of baseball, one of the most difficult skills to master is hitting. First, a hitter must be able to coordinate the swing of a bat with the location of a ball so that good contact with the ball can be made while swinging the bat. Once this is mastered, the hitter must next learn to make good contact with the ball at the various positions at which it may cross home plate, from an inside pitch to an outside pitch, and from a high pitch to a low pitch, and various combinations of these two variables.

In development of these skills, the trainer or coach uses a baseball tee to support a ball at a selected height above a representation of the baseball home plate. With the ball so positioned, the batter can practice swinging thereat to assist in the process of coordinating his hands with his eyes and in the development of his wrist and arm muscles.

Various practice batting tees have been developed in the past for this purpose. The practice tees developed to date, however, have had various limitations which have limited their overall acceptance in the baseball world. In some cases, the tees have not been adjustable and different tees must be used for different hitting zones. In other cases the tees have been partially adjustable, but not able to cover all the hitting zones. In many cases, the tees have been adjustable, but the adjustment has required considerable time and manipulation to obtain a tee in the desired position. In other cases, the tees have been very expensive to produce, and the cost has been prohibitive for many of the smaller teams.

Following are examples of the prior art which disclose many of the tees having the above-noted limitations: U.S. Pat. Nos. 4,383,686, 4,277,691, 4,516,771, 2,862,712, 4,508,340, 3,877,695, 2,616,692 and 3,489,411.

U.S. Pat No. 3,489,411 discloses and claims a baseball practice tee which is adjustable for certain areas, but the tee is limited by the fact that it does not cover certain outside areas and requires several adjustments before the hitting zone can be changed.

It is an object of the invention, therefore, to provide a new practice batting tee for baseball and softball which corrects many of the above-described limitations. It is a further object to provide an adjustable practice tee that makes it possible to achieve every hitting zone that a batter would experience in normal game. It is a further object to provide a new adjustable practice batting tee that can be quickly and easily adjustable to the new desired position. It is a further object to provide an adjustable practice batting tee that can be used to hold a plurality of balls to train for quick judgment of the hitter. It is a further object to provide a new adjustable hitting tee which has improved stability and easy movability. It is a further object to provide a new adjustable practice tee that can be produced at low cost and available to all baseball and softball teams. These and other objects of the invention will be apparent from the following detailed description thereof.

SUMMARY OF THE INVENTION

It has now been discovered that these and other objects may be accomplished by the new adjustable practice batting tees of the present invention which present for the first time an efficient and economical way for the training of young batters in all aspects of the hitting technique.

The new practice batting tees of the present invention broadly comprise a planar base, adapted to resting on the ground or similar surface, an elongated slotted horizontal support member adapted to moving over the top of the base and attached thereto by an adjustable locking means placed within the slot such that in the unlocked position the support member can be slid along the slot to a new location on the base and then locked in that desired position, an L shaped elongated tubular pedestal having a long tubular arm and a short tubular arm and being pivotedly attached by locking means in the center of a U shaped support which is firmly attached to the end of the elongated slotted horizontal support member such that the L shaped tubular pedestal can be pivoted to have one of the tubular arms in a vertical position and the other arm in a horizontal position, and vis a versa, and then locked in that position, and both of the arms of the L shaped tubular pedestal having attached at the open end an elongated resilient tubular member adapted to holding a ball at the top of the terminal end.

It has surprisingly been found that the new practice batting tee described above solves many of the defects noted for the prior art tees. The new practice tee, for example, provides for the first time a means to set up balls for every conceivable hitting zone, e.g. to set up balls for training in hitting high and low pitches, inside and outside pitches in a variety of different positions. In addition, the new tees provides a means for adjusting the tee to the different position very quickly and easily, e.g. by merely removing a locking pin and flipping the pedestal to a new position. The new tees also provide the unique feature of providing a setting for two or more balls in different position so that the trainer can test the alertness of the batter by quickly telling him to hit one or the other of the set up balls. Further advantage is found in the fact that the new practice tees have improved stability on the ground and can be easily moved from place to place without dismantling or other extensive operation. The new tees are also inexpensive to product and can be made available at low cost to all coaches and trainers involved in training young ball players.

DESCRIPTION OF THE DRAWINGS

The various objects and features of the present invention will be more fully understood by reference to the accompanying drawings.

DETAILED DESCRIPTION OF THE DRAWING

Figure 1:
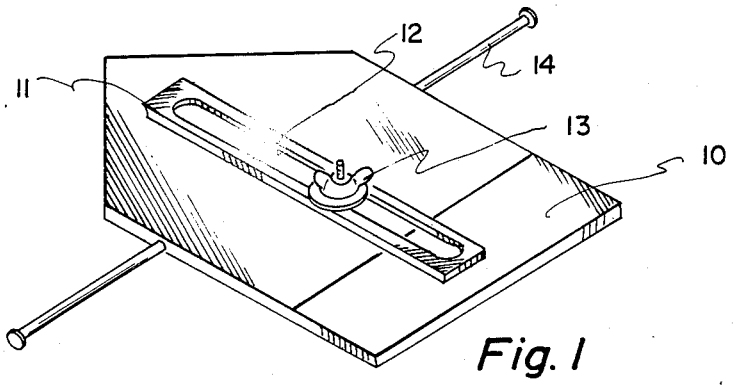
FIG. 1 is a perspective view of the top of the plate showing the locating of the slotted support member.

With reference to FIG. 1, the base plate having the conventional base size is shown as 10, with the slotted horizontal support member 11 having the open slot 12 with the adjustable locking means 13 placed within the slot and attached to the plate 10 by threaded means. Stabilizer member 14 is also shown in FIG. 1.

Figure 2:
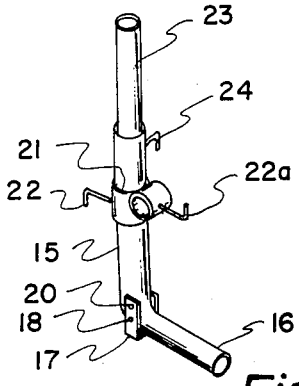
FIG. 2 is a side view of the L shaped pedestal.

FIG. 2 illustrates the tubular L shaped pedestal with member arms 15 and 16. Tubular member 15 is open at the top and contains a telescopic extension 23 which is held in position by lock bolt 24. Slip clamp 21 is attached to arm 15 and held in proper position by lock bolt 22. Additional L shaped members such as shown in FIG. 3 may be inserted in the clamp and held by lock bolt **22*a*** to provide an additional pedestal to hold another ball as described herein after.

Figure 3:
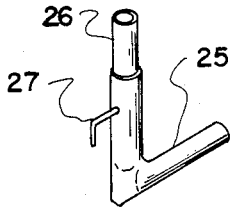
FIG. 3 is a side view of a side arm support member.

FIG. 3 illustrates such an additional L shaped arm 25 which may be inserted in slip clamp 21 and held at the proper position by lock bolt **22*a*. This additional arm also contains an telescopic extension 26 within the open end which is held in the proper position by lock bolt 27**.

Figure 4:
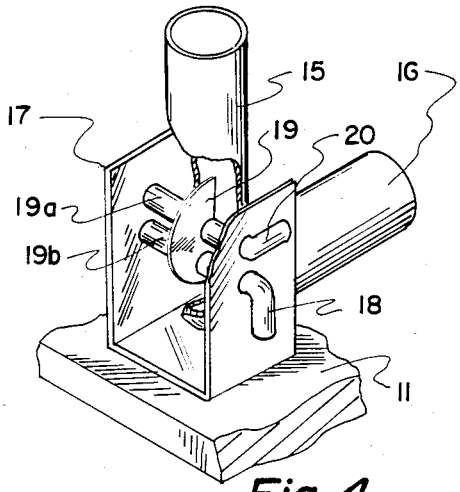
FIG. 4 is a side view of the U shaped support member showing the adjustment and locking means.

FIG. 4 illustrates the U shaped member 17 which holds the L shaped pedestal and is firmly attached to the slotted horizontal support member 11. Pivot member 19 is firmly attached to the upright arm of the L-shaped elongated pedestal and possesses slots **19*a* and 19*b* for the adjustment pin 18 and locking pin 20. The upright Lshaped member is held in the U shaped member 17 by the adjustment pin 18 and locking pin 20. When one desires to flip the L shaped elongated pedestal to have the shorter arm upright and the longer arm horizontal, one merely remove locking pin 20, flip the pedestal to the desired position and then insert locking pin 20**.

Figure 6:
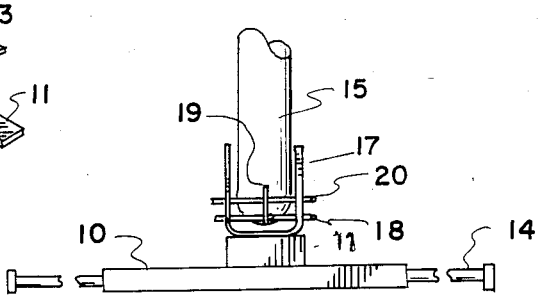
FIG. 6 is an end view of the plate showing the positioning of the slotted support member and the L shaped pedistal.

FIG. 6 is an end view of the plate and assembly showing the position of the planar plate 10, the slotted horizontal support member 11 to which is firmly attached U shaped member 17. The pivot member 19 is shown attached to the back of the L shaped pedestal with adjustment pin 18 and locking pin 20 passing through the pivot member. The upright arm 15 and the stabilizer element 14 are also shown. Horizontal arm 16 is behind 15 and not shown.

Figure 5:
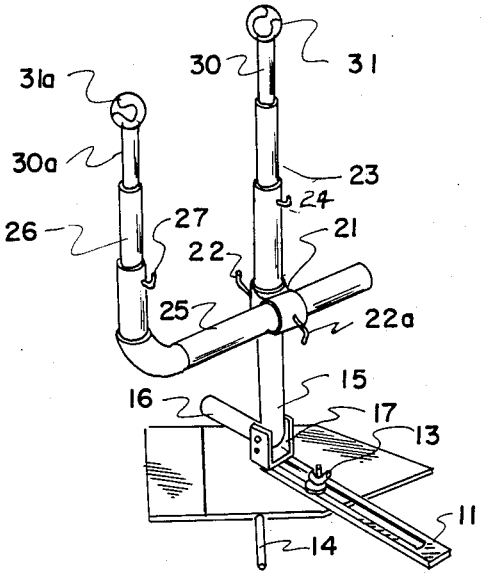
FIG. 5 is a perspective view of the assembled practice tee illustrating the use of the tee in holding two balls.

FIG. 5 is an illustration of the assembly of the tee apparatus in the event that one desires to set up two balls for selection for hitting by the coach or trainer. The longer L arm 15 is set upright with extension 23 to which is attached resilient hard rubber holder 30 to support baseball 31. Extension arm 25 is held by clamp 21 and has extension arm 26 held by lock bolt 27. Extension 26 is attached to hard rubber holder **30*a* which holds an additional baseball 31*a*. Slot 11 held by adjustment member 13 is moved over the base to position the upright member 23 and extension arm 26 in the training position. Stabilizer arms 14** are extended on both sides of the plate to give the tee the desired stability on the ground.

Figure 7:
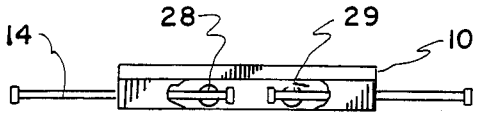
FIG. 7 is an end view of the planar base cut away to show the location of the stabilizers.

FIG. 7 is an end cut away section of the plate showing the positioning of the stabilizer arms under the plate in container 29 with spring means 28 to permit retention of the arms when not in use. Stabilizer arms can as desired be withdrawn from both sides of the plate to the length needed for the stabilization of the plate.

Figure 8:
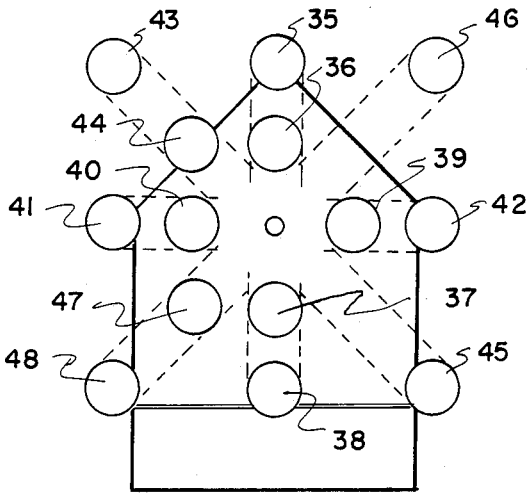
FIG. 8 is a diagram showing the various positions that the ball may be placed when using the new practice tee of the present invention.

FIG. 8 is a top view of the apparatus showing the various positions that the ball can be maintained by proper adjustment of the new tee apparatus. Positions are shown from 35 to 48 and illustrate, for example, inside balls 43, 44, 40, 41, 47 and 48, and outside balls 46, 39, 42,45, etc.

DETAILED DESCRIPTION OF THE INVENTION

While the above-described description of the invention and drawings has been made in rather specific terms, it should be understood that various changes can be made in construction and operation without departing from the scope of the present invention.

The planar base for the tee may be of any desired shape or size, and of any suitable material as long as it provides the base for the attachment of the slotted support member. In general, the base is of the conventional baseball shape and is made from strong sheet metal. Preferably, the plate is made from about 16 guage sheet metal with a $\frac{3}{4}$ inch bend for rigidity around the edge. The conventional shape of the baseball plate $17'' \times 17''$ is preferably painted white with a remaining portion generally $8'' \times 17''$ painted black and serving as a balance for the upright tee.

The elongated slotted horizontal support member to be adjustably attached to the above-noted plate may also be prepared in any desired size and construction as long as it provides a means for permitting the attached upright members to be revolved around the plate to any desired position. In general, the slotted horizontal support member is prepared from plate metal or steel plate of about $\frac{3}{8}'' \times 2''$ in size with a $\frac{1}{2}''$ by $18''$ slot down the center of the support member. The slotted support member is held against the top of the plate by any suitable means which would permit the support member to be moved across the plate to the desired position and then locked in that position. Preferably the slotted support member is held in such a position by means of a threaded lock bolt placed within the slot and threaded into a hole in the top of the plate. The slotted member passes freely past the bolt and can be placed in the desired position on the plate. The lock bolt can then be tightened down on the slotted support member to hold it securely in the proper position.

The L shaped tubular pedestal to be adjustably attached to the slotted support member can be of any size and construction as long as it provides the necessary support for the ball or balls to be hit. The Pedestal is preferably a ¾ to 1 inch steel pipe bent in an L shape or 90 degree angle to form two extended arms one arm being longer than the other and suitable for use in setting up the high ball, and a shorter arm suitable for use in setting up the low ball. Preferably the longer arm varies from about 28" to about 45", with the small arm varying from about 10" to about 16" in heighth. Both arms may, of course, be made up of or contain additional extended arms placed telescopically within the inside of the tubular arm and held by a lock bolt as shown in FIGS. 2 and 3.

At the terminal end of each of the upright members is placed a tubular resilient member to hold the ball being hit. The resilient member is preferably a hard rubber tubular hose which is of the size suitable for holding the baseball or softball at the upright end. The resilient member is held firmly to the upright members by means of an adhesive or clamp. The length of the resilient member may vary, but it is preferably from about 10 to 14 inches, which is generally sufficient to protect the metal support members from the bat.

The L shaped tubular pedestal described above is held in proper place by means of a U shaped support member firmly attached to the end of the slotted horizontal support member. In order to permit the L shaped tubular pedestal to be quickly flip from the long upright arm to the low upright arm, the L shaped member is held in the U support by means of a pivot member as shown in the drawings. Lock bolts may be used to hold the L shaped pedestal in the proper position, and then on removal, allow the pedestal to be flip and locked for the new position. While this has been described with specific pivot and locking means, other means for doing the same can be utilized as desired or necessary.

It is sometimes desirable to have at least two balls in place at one time so as to train the hitter for quick determinations, with the trainer at the last minute indicating which ball he wants hit. This can readily be accomplished by adding extender arms to the upright pedistal as shown in FIG. 6. In this case, the extender arm or arms can be held onto the main pedestal by means of the lock clamps as shown in FIG. 2. These extender arms are prepared from the tubular material as in the case of the pedestal and can be of varying size, e.g. from 10 to 12 inches in length, and will preferably possess at the terminal end the resilient member to hold the ball and protect the upright member from the wrong swing of the bat.

In order to give the tee added stability in the event of a wild swing or other disturbance, one preferably employs the stabilizing arms as shown in FIG. 7. These arms can be prepared in any manner and be of any length as long as they can be easily extended and withdrawn as needed. In general, the arms are prepared from ¼ to ½ inch steel rod spring loaded in a metal container under the plate so that they can be withdrawn at the desired length, e.g. from 4 to 12 inches, and then allow to slip back in the container for storage.

The apparatus of the present invention may be utilized in a variety of different ways depending on the need for instruction in batting practice. As indicated the apparatus can be used for batting practice for baseball or for softball or for any other games involving the hitting of a ball with a bat or racket.

For hitting balls of average heighth one would preferably use an apparatus with a single L shaped pedestal with the longer arm of about 29 to 49 inches high being utilized. In the event practice for hitting low balls is needed, one may flip the L shaped pedestal to have the shorter arm of about 14 to 29 inches in the upright position.

In the event practice is needed for hitting outside balls the slotted horizontal member could be adjusted to have the upright pedestal in positions such as No. 46 as shown in FIG. 8. If the need is for hitting inside balls, the slotted member could be adjusted to have the upright pedestal in a position such as No. 41 as shown in FIG. 8.

As noted above, it is sometimes necessary to test the alertness of the hitter in judging balls, and in this case it may be advisable to use an assembly of apparatus as noted in FIG. 6 where the upright pedistal has an extended arm to hold an additional bal, which can be of any type, and the coach would then indicate which ball he wants the batter to hit.

PREFERRED EMBODIMENT OF THE INVENTION

A preferred embodiment of the invention is described below. It should be understood, however, that this is given as a preferred assembly of apparatus for certain training schedules and is not to be regarded as limiting the invention in any way.

An apparatus for use in high and low balls is prepared as follows: A base plate 17"×25" is prepared from 16 guage sheet metal with a ¾ inch bend for rigidity around the edge. A section 8"×17" at the back of the plate is painted black and used as a balance for the tee. An adjustable slotted horizontal member was prepared from a ⅜"×2" steel bar with a ½"×18" slot. The slotted horizontal member was held in place on the surface of the plate by a ⅜" threaded locking means placed in the slot and through a threaded hole in the base plate approximately 10 inches from the front point of the base plate. A 3/16"×1" steel U unit is welded to the front end of the slotted horizontal member. An L shaped pedestal was prepared using a ¾" pipe 16" long with a 4" extension at a 90 degree angle from the end of the larger pipe. A 12" length of rubber hose is attached to the 16" pipe by a 1½" hose clamp to bring the pedistal to the proper heighth and to provide a place for holding the ball to be hit. Another length of rubber hose is attached to the short end of the L by means of a hose clamp to provide the proper heighth and receptacle for the ball in the event that a low ball is to be hit. The L shaped pedestal is maintained between the sides of the U unit noted above by means of a pivot member and lock bolts as shown in FIG. 4. In the event that a low ball is to be hit, the lock bolts can be removed and the L shaped pedestal quickly flipped so that the short extension is not the upright pedestal and the long arm is the horizonatal member.

The apparatus of the present invention can be utilized in a variety of different ways depending on the need for instruction in batting practice. As indicated, the apparatus can be used for batting practice for baseballs or softballs or even golf balls, or for any other games involving hitting of a ball with a bat or racket. For most purposes in practice hitting baseballs, the ball will be a practice or Wiffle ball which is lighter than the regular ball. However, particularly with the more developed teams, the ball may be a regular baseball.

The apparatus is operated by placing the tee at the desired position as noted above, placing the ball on top of the rubber tubular element and then allowing the batter to strike at the ball with the necessary swing.

I claim as my invention:

1. An adjustable practice batting tee comprising;

a. a planar base, b. an elongated slotted horizontal support member adapted to moving over the top of the base and held thereon by an adjustable first locking means placed within the slot and removably attached to the base such that in the unlocked position the support member can be slid along the slot to a new location on the base and then locked in that desired position, and c. an L shaped elongated tubular pedestal having a long tubular arm and a shorter tubular arm and being pivotedly attached by a second locking means in the center of a support which is firmly attached to the end of the slotted horizontal support member such that the L shaped tubular pedestal can be pivoted to have one of the tubular arms locked in a vertical position by said second locking and the other arm in a horizontal position at least one of said arms when in said vertical position having an elongated resilient tubular member adapted to hold a ball at the top end thereof.

2. A practice batting tee as in claim 1 wherein retractable stabilizer means extend out from both sides of the planar base.

3. A practice batting tee as in claim 1 wherein an additional tubular member (extends from the end of the long L arm in telescopic manner) is directly telescopically attached to the end of the long tubular arm of the L shaped pedestal and held in place by locking means through the (long L arm) said long tubular arm of the L shaped pedestal.

4. A practice batting tee as in claim 1 wherein an additional tubular member (extends from the end of the short L arm in telescopic manner) is directly telescopically attached to the end of the short tubular arm of the L shaped pedestal and held in place by locking means through (the short L arm) said short tubular arm of the L shaped pedestal.

5. A practice batting tee as in claim 1 wherein an additional L shaped pedestal having a short arm and a long arm is provided, additional pedestal having one of said arms clamped against the vertical arm of the original L shaped pedestal by means of a slip clamp.

6. A practice batting tee as in claim 1 wherein the planar base is representation of a baseball home plate.

7. A practice batting tee as in claim 1 wherein the base, the slotted support member and the L shaped pedestal are made of metal.

* * * * *